US007779870B2

(12) United States Patent
Homma et al.

(10) Patent No.: US 7,779,870 B2
(45) Date of Patent: Aug. 24, 2010

(54) METHOD AND EQUIPMENT FOR MANUFACTURING REINFORCED FIBER TEXTILE

(75) Inventors: Kiyoshi Homma, Shiga (JP); Akira Nishimura, Kyoto (JP); Ikuo Horibe, Ehime (JP); Eisuke Wadahara, Ehime (JP)

(73) Assignee: Toray Industries, Inc., Tokyo (JP)

( * ) Notice: Subject to any disclaimer, the term of this patent is extended or adjusted under 35 U.S.C. 154(b) by 1206 days.

(21) Appl. No.: 10/570,701

(22) PCT Filed: Sep. 5, 2003

(86) PCT No.: PCT/JP03/11343

§ 371 (c)(1),
(2), (4) Date: Mar. 6, 2006

(87) PCT Pub. No.: WO2005/024111

PCT Pub. Date: Mar. 17, 2005

(65) Prior Publication Data

US 2007/0023099 A1 Feb. 1, 2007

(51) Int. Cl.
*D03D 1/00* (2006.01)

(52) U.S. Cl. ..... 139/420 R

(58) Field of Classification Search ..... 139/383 R, 139/42 C, 426 R, 42 R, 42 A, 420 C, 420 R, 139/420 A; 428/225; 29/99; 28/137, 132, 28/140; 100/210

See application file for complete search history.

(56) References Cited

U.S. PATENT DOCUMENTS 3,919,028 A * 11/1975 Lewis et al. ..... 156/148
4,078,323 A 3/1978 Baumgarten
4,932,107 A * 6/1990 Gotoh et al. ..... 28/137

(Continued)

FOREIGN PATENT DOCUMENTS

FR 2478693 A1 9/1981

(Continued)

OTHER PUBLICATIONS

Translation of JP 2003-268669 from Japan's Industrial Property Digital Library (IPDL).*

(Continued)

*Primary Examiner*—Shaun R Hurley
*Assistant Examiner*—Andrew W Sutton
(74) *Attorney, Agent, or Firm*—RatnerPrestia

(57) ABSTRACT

A method for producing a reinforcing fiber woven fabric of the invention is a method for producing a reinforcing fiber 1 for weaving the reinforcing fiber as at least a warp 2. The yarn width of at least the warp 2 constituting the woven fabric is widened in the direction of the weft 3 by reciprocating cylindrical bodies 4 in the direction of the warp 2 of the woven fabric while rolling the cylindrical bodies 4 in a pressurization state to the woven fabric 1

A apparatus for producing a reinforcing fiber woven fabric of the invention comprising: a guide roller 5 which comes into contact with the surface of a reinforcing woven fabric continuously passing through at a predetermined winding angle and rotates; a plurality of cylindrical bodies 4 rotatably supported on the woven fabric which comes into contact with the surface of the guide roller 5; and driving parts 6 to 10 for reciprocating the cylindrical bodies in the direction of the warp 2 of the woven fabric.

14 Claims, 3 Drawing Sheets

U.S. PATENT DOCUMENTS

| | | | | |
|---|---|---|---|---|
| 5,732,748 | A * | 3/1998 | Aucagne et al. | 139/383 R |
| 5,783,278 | A | 7/1998 | Nishimura et al. | |
| 5,939,338 | A | 8/1999 | Aucagne et al. | |

FOREIGN PATENT DOCUMENTS

| | | | |
|---|---|---|---|
| GB | 1463969 | A | 2/1977 |
| JP | 2-307965 | A | 12/1990 |
| JP | 4-241164 | A | 8/1992 |
| JP | 6-136632 | | 5/1994 |
| JP | 2001-316971 | | 11/2001 |
| JP | 2003-268669 | A | 9/2003 |
| WO | WO 0075410 | A1 | 12/2000 |

OTHER PUBLICATIONS

International Search Report dated Dec. 16, 2003, application No. PCT/JP03/11343.

European Search Report, application No. EP 03818577, dated Apr. 26, 2007.

* cited by examiner

METHOD AND EQUIPMENT FOR MANUFACTURING REINFORCED FIBER TEXTILE

This application is a U.S. National Phase application of PCT International Application PCT/JP03/11343 filed Sep. 5, 2003.

TECHNICAL FIELD

The invention relates to the improvement of a method for producing a reinforcing fiber woven fabric and an apparatus thereof. Particularly, the invention relates to the improvement of a method for producing a reinforcing fiber and an apparatus adding an improvement to the widening of the yarn width when producing a reinforcing fiber woven fabric useful as a base material for fiber reinforced plastics

BACKGROUND ART

Conventionally, one having a form of woven fabric has been abundantly used as an intermediate base material when producing a fiber reinforced plastic. In the woven fabric for reinforcement, a thin reinforcing fiber yarn is used for a warp and a weft so as to reduce crimp due to the interlacing of the warp and weft as much as possible to exhibit high intensity expression.

Since a thin yarn causes the low productivity of the yarn itself and woven fabric when the reinforcing fiber is particularly a carbon fiber yarn, the reinforcing woven fabric and has been mainly used for an airplane use or the like having large weight saving effect.

However, the low cost of the material is strongly hammered out due to the stagnation of the latest aircraft industry, and the appearance of inexpensive carbon fiber woven fabric has been desired.

Under such a condition, a carbon fiber flat yarn woven fabric obtained by interlacing thick carbon fiber yarns in a flat shape has been proposed in, for example, Japanese Patent Application Laid-Open (JP-A) No. 6-136632. Since the woven fabric is woven in large woven pitch by using the carbon fiber yarn of the thick fineness of inexpensive manufacture cost, the productivity of the woven fabric is also high, and the inexpensive woven fabric can be provided. Also, the high strength is exhibited since the crimp at the interlacing point of the weaving yarn is also small.

However, since a lot of multi-filament consisting of the carbon fiber converged by few sizing agent such that the yarn bundle section is the flat shape, the flat yarn bundle is crushed by the weaving step so as it makes the yarn narrower, and a gap is generated between the weaving yarns in the woven fabric. Therefore, the woven fabric is used and formed into a fiber reinforced composite material molded object (hereinafter, referred to as molded object), the molded object in which the resin is unevenly dispersed between the weaving yarns is obtained. The molded object having the high content of the carbon fiber is not obtained. Also, when the stress acts on the molded object, a portion in which the resin is unevenly dispersed becomes the starting point of destruction, and high mechanical property is not exhibited. Since a portion where a resin is unevenly dispersed in a molded object is greatly shrunk by the consolidation of the resin, a molded object in which the resin is unevenly dispersed is depressed, and unevenness is generated on the surface of the molded object.

Examples of the factors in which the gap is formed between the weaving yarns include the followings.

(1) A gap is generated around fine narrow yarn by the changing of the yarn width of a carbon fiber flat yarn itself.

(2) When a bobbin around which a carbon fiber yarn is wound is unwound, a temporal twist is mixed by the winding curl, and the twist part results in narrower, thereby the gap generated between the weaving yarns.

(3) A related position of a heddle for opening the warp and a dent is shifted, and the width of the warp becomes narrow. The gap is generated between the weaving yarns.

(4) When the weft is beat, the width of the weft becomes narrow, and the gap is generated between the wefts.

Conventionally, for such problems, the method for performing the rotational movement of many spherical bodies under a pressurization state to closed the opening point of the woven fabric after making the woven fabric is proposed in Japanese Patent Application Laid-Open (JP-A) No. 2-307965.

According to the method, since the yarn bundle of the weaving yarn is converged as the section of the bundle is almost a circular shape in the woven fabric in which the thin carbon fiber yarn having the number of filaments of about 3,000 is woven in the small weaving yarn pitch, the yarn width is widened by pushing the weaving yarn at the convex part of the spherical body, and the opening is closed.

However, in the woven fabric having large weaving yarn pitch like the flat yarn woven fabric consisting of the carbon fiber, the convex part of the spherical body (central part of the ball) may be located between the flat weaving yarns. Since the convex part of the spherical body is rolled between the weaving yarns in that condition, the operation for enlarging the gap between the weaving yarns acts, and the yarn width is narrowed on the contrary. Since the rotation of the spherical body is not lightly rotated by friction with a positioning mesh, the woven fabric slippage is easily generated by the movement of the spherical body in the flat yarn woven fabric where the binding force between the warp and the weft is weak and the woven fabric slippage is easily and simply generated.

Thereby, the above prior art has a fault, and the appearance of the producing method adding the improvement to the producing method and apparatus is desired when the flat yarn woven fabric made of the carbon fiber which has large weaving yarn pitch as the reinforcing fiber and easily generates the woven fabric slippage is used.

It is an object of the invention to solve the above conventional problems and provide the method and the apparatus for producing the reinforcing fiber woven fabric which has no opening between the weaving yarns and in which the reinforcing fiber is uniformly dispersed by adding an effective yarn width widening method in the producing step when producing the reinforcing fiber woven fabric using the flat yarn as the weaving yarn.

DISCLOSURE OF THE INVENTION

So as to attain the above object, the method for producing the reinforcing fiber woven fabric of the invention is as follows.

In a method for producing a reinforcing fiber woven fabric in which a reinforcing fiber is woven as at least a warp, the method comprises the step of reciprocating a cylindrical body in the direction of the warp of the woven fabric on the woven fabric while the cylindrical body is rolled in a pressurization state to the woven fabric to widen the yarn width at least of the warp constituting the woven fabric in the direction of a weft.

In the method for producing the reinforcing fiber woven fabric, the pressure force of the cylindrical body to the woven fabric is preferably 100 to 2000 g per 1 cm of the length of the axial direction of the cylindrical body.

In the method for producing the reinforcing fiber woven fabric, a widening rate for widening the yarn width of the warp in the direction of the weft is preferably 2 to 50%.

In the method for producing the reinforcing fiber woven fabric, it is preferable that thick reinforcing fiber yarns of non-twist having a fineness of 400 to 4000 TEX are arranged in a weaving yarn pitch of 5 to 32 mm, and the fineness and weaving yarn pitch of the reinforcing fiber yarn have the following relationship.

$$P=k\cdot T^{1/2}$$

wherein

P: weaving yarn pitch (mm),

T: fineness of reinforcing fiber (TEX), k: (18 to 50)$\times 10^{-2}$.

In the method for producing the reinforcing fiber woven fabric, it is preferable that thick reinforcing fiber yarns of non-twist having a fineness of 400 to 4,000 TEX are arranged in a weaving yarn pitch of 4 to 16 mm; the woven fabric is a uni-directional woven fabric integrated by the weft yarn of a thin auxiliary yarn having a fineness of 1 to 30 TEX; and the fineness and weaving yarn pitch of the reinforcing fiber yarn have the following relationship.

$$P=k\cdot T^{1/2}$$

wherein

P: weaving yarn (warp yarn) pitch (mm),

T: fineness of reinforcing fiber (TEX), k: (10 to 28)$\times 10^{-2}$.

In the method for producing the reinforcing fiber woven fabric, the reinforcing fiber is preferably a carbon fiber.

In the method for producing the reinforcing fiber woven fabric, the number of filaments of the carbon fiber is preferably 6000 to 50000.

In the method for producing the reinforcing fiber woven fabric, it is preferable that multiple cylindrical bodies are alternately staggered in the direction of the warp to widen the yarn width of the woven fabric.

In the method for producing the reinforcing fiber woven fabric, it is preferable that the woven fabric is moved in the direction of the warp along the surface of a guide roller capable of being rotated to continuously widen the yarn width of the woven fabric contacting with the surface of the guide roller.

In the method for producing the reinforcing fiber woven fabric, the yarn width is preferably widened between a cloth fell of a loom and a winding roll of the woven fabric.

In the method for producing the reinforcing fiber woven fabric, it is preferable that an average speed for reciprocating the cylindrical body is set at 50 to 300 mm/second.

In the method for producing the reinforcing fiber woven fabric, it is preferable that the woven fabric is a flat yarn woven fabric having a warp and a weft consisting of a carbon fiber yarn and having a flat woven fabric of plain weave, the method comprising the steps of: opening and widening the weft by air jet injection from injection holes aligned in the direction of the weft of the woven fabric; and widening the yarn width in the direction of the weft by any one of the above methods.

In the method for producing the reinforcing fiber woven fabric, it is preferable that the method comprising: a weaving step of weaving a woven fabric while inserting a low melting point resin fiber in the direction of a warp or a weft; a widening step of widening a yarn width according to any one of the description above; and a sticking step of heating the woven fabric to the softening point or melting point of the low melting point resin fiber or higher to stick the reinforcing fibers with each other or a reinforcing fiber and an auxiliary yarn by the low melting point resin.

In the above method for producing the reinforcing fiber woven fabric (of course, the widening step is contained in this producing method), it is preferable that the method further comprises the step of applying and adhering a powdery or fibrous resin on one side or both sides of the reinforcing fiber woven fabric, and the adhering amount of the resin is 2 to 20% by weight of the woven fabric.

Next, so as to attain the above object, the apparatus for producing the reinforcing fiber woven fabric of the invention is as follows.

An apparatus for producing a reinforcing fiber woven fabric, comprises: a guide roller which comes into contact with the surface of a reinforcing woven fabric continuously passing through at a predetermined winding angle and rotates; a plurality of cylindrical bodies rotatably supported on the woven fabric which comes into contact with the surface of the guide roller; and a driving part for reciprocating the cylindrical bodies in the direction of the warp of the woven fabric.

In the apparatus for producing the reinforcing fiber woven fabric, it is preferable that the cylindrical body has a diameter of 10 to 40 mm and a length of 10 to 50 mm, and cylindrical bodies are alternately staggered in the direction of the warp of the woven fabric.

DESCRIPTION OF THE SYMBOLS IN THE DRAWINGS

Figure 1:
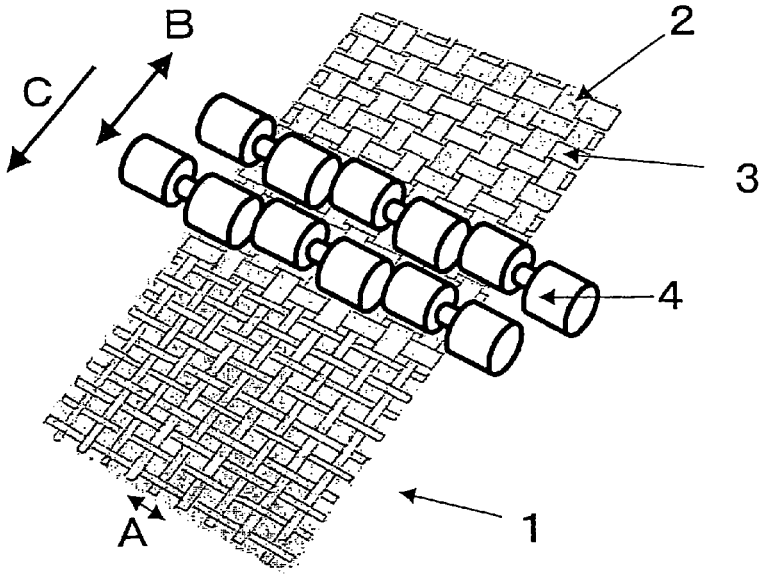
FIG. 1 is a schematic perspective view for explaining the method of the invention.

1: woven fabric
2: warp
3: weft
4: cylindrical body
5: guide roller
6: cylindrical body supporting arm
7: reciprocation coupling rod
8: pressing member
9: guide
10: compression spring

BEST MODE FOR CARRYING OUT THE INVENTION

Hereinafter, the best mode of the invention will be described by using examples, comparative examples and accompanying drawings of the invention.

FIG. 1 is a perspective view for explaining the method for producing a reinforcing fiber woven fabric using a yarn width widening method as the feature of the invention.

In FIG. 1, numeral 1 designates a woven fabric using a reinforcing woven fabric for a fiber reinforced plastic, and a so-called bi-directional woven fabric obtained by interlacing a warp 2 and a weft 3 of a reinforced yarn each other and weaving them. Since the bi-directional woven fabric 1 itself can be woven by a known method, such as using a rapier loom, the explanation to the weaving step is omitted herein.

Numeral 4 designates a cylindrical body for widening the woven fabric 1 in the direction of the weft 3 (the direction of an arrow A of FIG. 1) and having a dumbbell shape. In the example, a plurality of cylindrical bodies are arranged in parallel so that the rotating shafts are corresponded to the direction of the weft of the woven fabric, and the woven fabric 1 is widened by reciprocating the cylindrical bodies in the direction of the warp 2 (the direction of an arrow B) in the pressurization state of a suitable pressing force to the woven fabric 1. The width of the each weaving yarns is widened by the widening step, and thereby a uniform woven fabric having no gap between the weaving yarns is obtained.

As the pressurization method of the cylindrical body 4 of this case to the woven fabric 1, the woven fabric 1 can be pressurized, for example, by a spring or an air cylinder. Though the widening effect is preferably large when the pressure force is high as much as possible, there is a problem which shags are generated when the pressure force is too high and particularly the reinforcing fiber is the carbon fiber, and the load of 100 to 2000 g per 1 cm of the length of the cylindrical body is preferably applied in a direction perpendicular to the surface of the woven fabric.

Faster a speed for reciprocating the cylindrical body 4 is, more many times the cylindrical body 4 can pass the same parts of the woven fabric, and higher the widening effect can be. However, the reciprocation of the cylindrical body is mechanically limited, and the speed of the reciprocation (the product of amplitude (mm) and frequency (time/second)) is preferably 50 to 300 mm/second. So as to reciprocate the same parts of the woven fabric frequently as much as possible in such speed range, sequences of plural cylindrical bodies are arranged. Thereby, reciprocation with the plural cylindrical bodies results in the same movement with passing though the same parts of the woven fabric plural times, and the high effect is obtained in spite of less frequency. Though the widening effect can be obtained by the method for reducing the amplitude to enlarge the frequency as the widening condition, it is necessary to widen the woven fabric in the range where the widening operation is very short distance, and thereby the woven fabric cannot be fully widened.

On the other hand, since the yarn widening is sequentially performed over a long distance by enlarging the amplitude, the width can be uniformly and greatly widened. The amplitude is preferably 10 to 100 mm, and more preferably about 20 to about 50 mm.

FIG. 1 shows the case where the woven fabric is in a rest state, and in this case, the cylindrical body 4 is sequentially moved in the direction of the arrow C while the cylindrical body 4 is reciprocated in the direction of the arrow B, and the woven fabric can be moved off by a suitable means when the yarn width widening of a woven fabric interval is completed. In this case, though the cylindrical body 4 may be reciprocated while being rolled, the cylindrical body 4 may be moved to one direction without reciprocating. It is preferable to move the cylindrical body 4 while reciprocating since large effect is obtained by the movement passing through the same parts of the woven fabric plural times.

Figure 2:
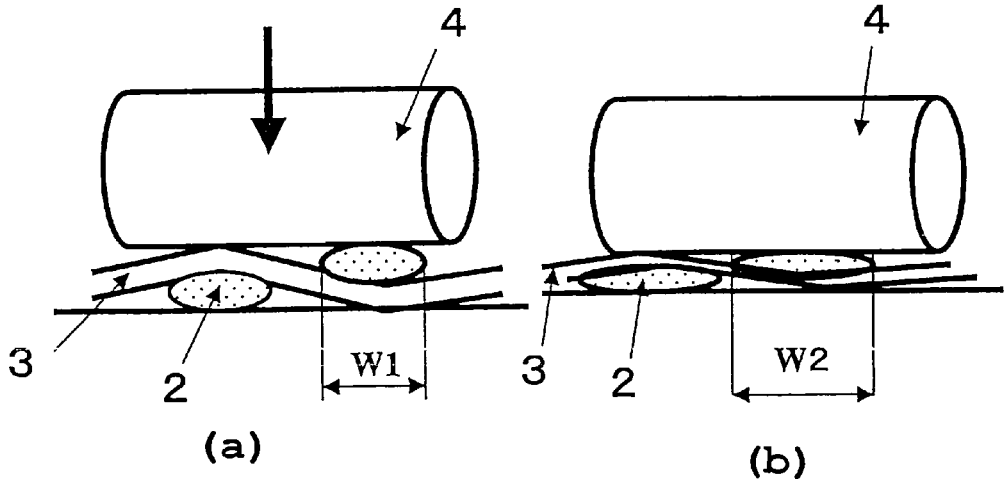
FIG. 2 is a partial-sectional view for explaining a principle of the method of the invention.

FIG. 2 is a partial sectional view for explaining a widening principle for widening the weaving yarn in the width direction, and shows a cutting plane in the direction of the weft 3 of the woven fabric 1 coming into contact with the cylindrical body 4. As shown in FIG. 2 (*a*), the narrow width W1 of the warp 2 means that the section of the reinforcing fiber bundle has the ellipse form closed to circular and the woven fabric has a shape swelling up to the thickness direction. When the swelling portion is vertically pressurized in the direction of an arrow by the cylindrical body 4 to the surface of the woven fabric, the reinforcing fiber bundle of the warp 2 is pushed out in the direction of the weft 3. As shown in FIG. 2 (*b*), the yarn width of the weft 2 is widened and is set to W2. When the cylindrical body 4 is rolled in the direction of the warp 2 in such a state, the yarn width of the warp 2 can be sequentially widened in the direction of the weft 3. When both the warp 2 and the weft 3 are a reinforcing fiber and the warp 2 and the weft 3 interlace each other, the warp 2 and the weft 3 resist the widening of the yarn width due to the interlace. Thereby, it is difficult to widen the yarn width until the gap between the weaving yarns is completely eliminated by only one movement of the cylindrical body 4. Then, a means for making the cylindrical body 4 passing through the same parts several times to sequentially widen the yarn width is preferable, and therefore, it is preferable to reciprocate the cylindrical body 4 in the direction of the warp.

Though the yarn width of various reinforcing fiber woven fabrics can be fully widened by the above principle, the binding force of the warp and weft is strong and the weaving yarns are hardly moved in the case of a usual woven fabric in which the weaving yarns 2, 3 are woven at high density and are firmly interlaced each other.

Then, the method of the invention exhibits the effect when producing the flat yarn woven fabric woven by the thick non-twist reinforcing fiber yarn having the fineness of, particularly, 400 to 4,000 TEX, and which is a low areal weight woven fabric of 80 to 300 g/m$^2$ woven in the large pitch of the weaving yarn of 5 to 32 mm. That is, though the weaving yarns converged during weaving become narrower easily and cause a gap between the weaving yarns in the low areal weight woven fabric consisting of the thick reinforcing fiber yarn, the occurrence of such gap is prevented according to the method of the invention, and the woven fabric having no gap between the weaving yarns can be manufactured.

As the reinforcing fiber yarn used for the method for producing the reinforcing fiber woven fabric of the invention, a carbon fiber, a glass fiber, an aramid fiber, a synthetic fiber having high strength or the like can be used. Among these, the carbon fiber having high specific tensile strength and specific modulus is preferable. When producing the flat yarn woven fabric using the flat yarn consisting of the thick carbon fiber yarn as the form of the reinforcing fiber, it is necessary to keep the flat state of the carbon fiber held in the flat shape by sizing agent during weaving. Since the form of the flat yarn is held by a sizing agent, the flat state is crushed by the following factor in the weaving step, and the woven fabric cannot be made by keeping the nearly same yarn width as that of the weaving yarn pitch. The weaving yarn ends up with narrower in width, and the woven fabric having the gap between the weaving yarns is made.

Since the producing method of the invention widens the weaving yarn while rolling the cylindrical body 4 in the pressurization state, the producing method has a feature that the yarn width can be widened even if the sizing agent is adhered to the carbon fiber yarn and the fibers are adhered with each other. In the invention, this feature is effective for widening the yarn width of the reinforcing fiber consisting of the carbon fiber yarn to which a sizing agent of 0.5 to 2.0% is adhered.

Since the binding force of the warp 2 and weft 3 is fortunately very weak in the woven fabric using the above carbon fiber flat yarn for the reinforcing fiber and the woven fabric has almost no resistance inhibiting the spread property due to the interlacing, it is easily spread in the direction of the woven fabric plane by applying pressure on the woven fabric.

The flat yarn woven fabric 1 consisting of the above carbon fiber has preferably the thick non-twist carbon fiber yarns having the fineness of 400 to 4,000 TEX and the number of filament of 6,000 to 50,000 as at least the warp 2, arranged in the large weaving yarn pitch of 5 to 32 mm. It is preferable that the weaving yarn pitch relates to the fineness of the carbon fiber yarn to be used, and the carbon fiber flat yarn woven fabric has the following relationship.

$$P=k\cdot T^{1/2}$$

wherein

P: weaving yarn pitch (mm),

T: fineness of reinforcing fiber (TEX), k: (18 to 50)$\times 10^{-2}$

That is, the above formula shows that the woven fabric should have the weaving yarn pitch comparatively small when using the carbon fiber yarn having the small fineness and woven fabric should have the large weaving yarn pitch when using the carbon fiber yarn having the large fineness. The above range of the constant k is important in the flat yarn woven fabric to which the above formula is applied. The constant k of less than $18\times 10^{2}$ reduces the weaving yarn pitch, and the flat yarn woven fabric gets close to the usual carbon fiber woven fabric. Since the woven fabric has small gap formed between the weaving yarns, the woven fabric has no necessity of widening of the width of the weaving yarn.

On the other hand, when the constant k exceeds $50\times 10^{-2}$, there works almost no binding force to the weaving yarn, and the woven fabric becomes very loose. Since winding tension is applied to the warp set in the direction for reciprocating the cylindrical body in the invention, the yarn width can be widened without messing around the arrangement. Since the tension is not applied and the arrangement is easily messed up referring to the weft, the weft is moved in a meandering manner by the movement of the cylindrical body.

The woven fabric 1 is preferably a uni-directional woven fabric comprised of the thick non-twist reinforcing fiber having the fineness of 400 to 4,000 TEX arranged in the direction of the warp 2 in the weaving yarn pitch of 4 to 16 mm, integrated by the weft 3 consisting of the thin auxiliary yarn having the fineness of 1 to 30 TEX, and satisfying the relationship between the fineness of the reinforcing fiber yarn and the weaving yarn pitch as follows.

$$P=k\cdot T^{1/2}$$

wherein

P: weaving yarn pitch (mm),

T: fineness of reinforcing fiber (TEX), k: (10 to 28)$\times 10^{2}$

The weft consisting of an auxiliary yarn in the uni-directional woven fabric is mainly used for integrating the warp arranged by interlacing with the reinforcing fiber yarn. The weft as the auxiliary yarn is preferably the thin yarn so as to reduce the crimp of the reinforcing fiber yarn due to the interlacing as much as possible.

When the weft is the thin yarn of less than 1 TEX, the force for integrating the warp of the reinforcing fiber lacks, and the weft is cut by the small external force. Thereby, the object of the integration cannot be attained.

On the other hand, when the fineness of the weft exceeds 30 TEX, the crimp is generated in the warp of the reinforcing fiber yarn by the interlacing, or the weft is generated in the convex shape on the surface of the reinforcing fiber ending up with making the surface unevenness larger. The fineness of the weft is preferably 1 to 10 TEX. Though the relationship of the fineness and pitch of the reinforcing fiber at the time of limiting to the uni-directional reinforcing fiber woven fabric is the same as that of the above description, the weft of the uni-directional woven fabric in the invention has the very thin fineness and the binding force in the interlacing part of the warp yarn and weft yarn is small. The constant k is preferably 0.01 to 0.28 as a value smaller than the above case.

As described above, in the manufacture of the flat yarn woven fabric made of the carbon fiber having the relationship of the fineness and weaving yarn pitch of the above carbon fiber yarn, the method for producing the reinforcing fiber woven fabric using the method for widening the yarn width as the feature of the invention widens the yarn width while rolling the cylindrical body in the pressurization state on the woven fabric. Thereby, the operation effect is greatly exhibited.

The producing method of the invention reciprocates the cylindrical body 4 in the direction of the warp yarn to widen the width. Since the section of the yarn bundle in which filaments gather referring to the warp 2 is continuously and sequentially widened in the yarn axial direction, the yarn width can be effectively widened. However, since the section of the yarn bundle is only momentarily crushed referring to the weft 3, the widening effect is less than that of the warp.

Then, so as to solve this problem, referring to the weft 3, after the weft of the woven fabric is previously opened and widened by air jet injection, the cylindrical body can be smoothly rolled by the method for widening the warp by the cylindrical body, and that is preferable because the yarn width of the warp and weft can be certainly widened. In such an opening widening apparatus using the air jet, for example, a nozzle having air injection holes having a diameter of 0.2 to 0.5 mm and arranged in the pitch of several mm is provided so as to face the surface of the woven fabric in parallel with the direction of weft of the woven fabric woven on the loom, and the weft is opened and the yarn width is widened at the same time when the woven fabric passes while injecting air. At this time, since the winding tension is applied to the warp 2, it is difficult to widen the yarn width of the warp by the air jet. Thus, when the weft 3 is previously opened, the yarn width of the narrow warp can be opened while the cylindrical body 4 is smoothly rotated. Simultaneously, a portion where the spread is a little insufficient can be also widened by the air opening.

When the method for producing the reinforcing fiber woven fabric of the invention is used for the method for producing the flat yarn woven fabric made of the carbon fiber, the weave style is not particularly limited, and may be the plain weave, the twill weave and the satin organization. However, the plain weave in which the warp and the weft interlace alternatively is preferable since it is hard to generate the woven fabric slippage.

In the producing method of the invention, when a sealing woven fabric is manufactured by inserting a low melting point resin fiber in the direction of the warp and/or the weft in the woven fabric and by heating the woven fabric to the softening point or melting point of the low melting point resin fiber or the higher to stick the reinforcing fibers each other, the weaving yarn is heated after the weaving yarn is widened by the above widening method of reciprocating the cylindrical body in the direction of the warp of the woven fabric while rolling the cylindrical body in the pressurization state to woven fabric on the woven fabric into which the low melting point resin fiber is inserted. Thereby, the weaving yarn is adhered in a state where the weaving yarn is widened, and the molding material of woven fabric in which the reinforcing fiber is uniformly dispersed can be provided, which has excellent handling without changing the woven fabric structure at the time of future handling can be provided.

As an embodiment of the method of inserting the low melting point resin fiber, there is a method in which the resin fiber is pulled, arranged and supplied to the warp and/or the weft of the carbon fiber at the time of weaving in the case of a bi-directional woven fabric. In the case of a uni-directional woven fabric using the thin auxiliary yarn as the weft for the warp of the carbon fiber, the low melting point resin fiber is pulled and arranged together with the auxiliary yarn. The insertion can be secured by using a covering yarn which has a core/sheath configuration as the auxiliary yarn and by making the sheath portion of the low melting point resin fiber.

The core yarn of the covering yarn having a core/sheath configuration is preferably the fiber yarn which causes almost no heat shrinkage at the heating temperature at the time of performing the heat fusion of the low melting point resin and has the shrinkage percentage of 1% or lower in the dry heating condition of 150° C. The core yarn is preferably the thin fineness yarn consisting of a glass fiber, an aramid fiber yarn or a vinylon fiber.

Examples of the low melting point resins include copolymer nylon and copolymer polyester having a melting point of 90 to 180° C.

In the producing method of the invention, a reinforcing material in which reinforcing fiber is uniformly dispersed can be provided by applying and adhesion of the powdery or fibrous resin after the widening step of the weaving yarn similarly, even when a woven fabric is going to be stabilized, be piled up and adhere each other, or undergo to the interlayer toughening by applying and adhesion of the powdery or fibrous resin on one side or both sides of the woven fabric Examples of the resins for being applied and adhered include a thermosetting resin or a thermoplastic resin. Examples of the thermosetting resin include epoxy, phenol, unsaturated polyester, vinylester, and a resin including a curing agent or a catalyst. Examples of the thermoplastic resins include polyester, polyamide, polyurethane, polyether sulfone, a copolymer a modifier and a mixture of two or more kinds thereof. The adhering amount of the powdery or fibrous resin at this time is preferably 2 to 20% by weight although it is according to the object. The adhering amount of the resin is preferably larger in view of the form stability of the woven fabric. However, when the adhering amount of the resin exceeds 20% by weight, the whole surface of the woven fabric is covered by the resin, and the impregnation of a matrix resin is inhibited in the case of the injection-mold of the resin. The adhering amount of the resin exceeding 20% by weight requires for the impregnation for a long time, and a non-impregnation part is formed.

On the other hand, when the adhering amount of the resin is less than 2% by weight, the powdery or fibrous resin cannot be uniformly dispersed on the surface of the woven fabric. Since parts where the reinforcing fibers do not adhere each other exist, the shape retainability of the woven fabric is inadequate, the optimal adhering amount is the above range.

The resin can be adhered on the surface of the woven fabric by uniformly applying the powdery resin on the woven fabric in which the yarn width of the weaving yarn is widened and heating it when the powder is used as the resin in the method of applying or adhering it on the woven fabric 1. The resin can be also adhered by passing the woven fabric through a heating roller. The resin can be adhered on the woven fabric by heat fusion or needling in the case of using the fiber as the form of the non-woven fabric.

It is possible to adhere at comparatively low temperature by mixing the low melting point resin of 10 to 40% by weight when performing a heat fusion by using melt blow and span bond or the like as the non-woven fabric. As described above, since the whole surface of the woven fabric is not covered with the resin by adhering the powdery or fibrous resin on the surface of the woven fabric, the channel of the matrix resin is secured, and the impregnation of the resin is not prevented.

Next, the apparatus for the woven fabric according to the invention will be explained using FIGS. 3 to 5.

Figure 3:
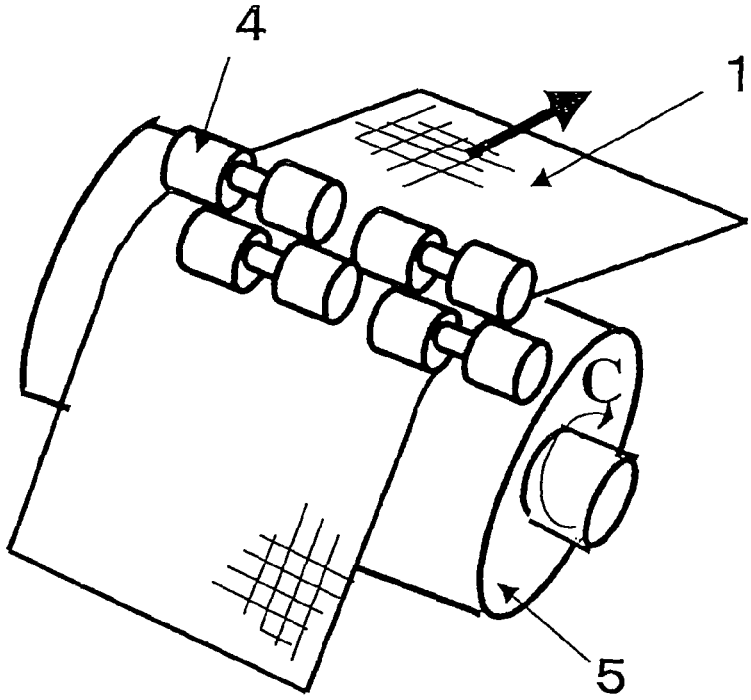
FIG. 3 is a perspective view of an embodiment for continuously performing the method of the invention on a loom.
Figure 4:
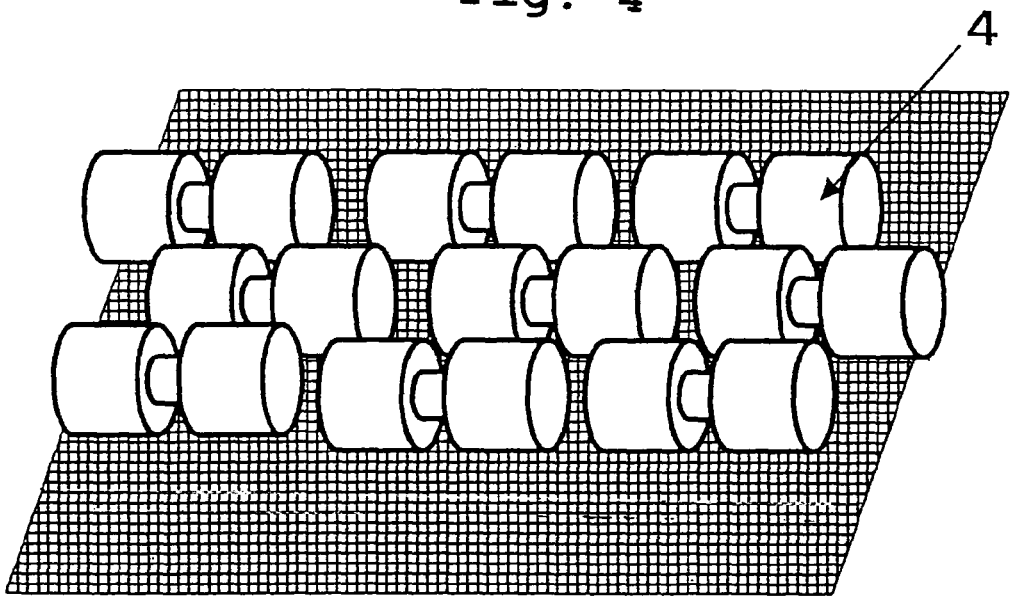
FIG. 4 is a plane view for explaining an arranging method for a cylindrical body of the invention.

FIG. 3 is a perspective view of the preferred arrangement example of the cylindrical body 4 of FIG. 1. The yarn width of each yarn constituting the woven fabric is continuously widened by reciprocating the cylindrical body 4 with a fixed amplitude in the direction of the warp on the woven fabric 1 coming into contact with the guide roller 5 while moving the woven fabric 1 in a C direction of FIG. 3 along the surface of the guide roller 5 capable of being rotated. Though the illustration is omitted, the cylindrical body 4 is rotatably supported by a suitable roller bearing to the both ends of one shaft, and the cylindrical body 4 can be reciprocated in the direction of the warp by a means for supporting the central part of the axis and reciprocating. The pressure force to the woven fabric 1 can be suitably adjusted by a forcing means.

The cylindrical guide roller 5 is a rotating roller having a diameter of about 100 to about 500 mm and having a smooth surface, and the guide roller 5 is passively rotated according to the movement of the woven fabric by the frictional force when the woven fabric comes into contact with the surface of the guide roller 5.

Thus, the woven fabric 1 is abutted at a suitable winding angle to the peripheral curved surface of the guide roller 5, the tensility in the direction of the warp of the woven fabric acts in the direction of the central axis of the guide roller 5. Therefore, the high friction force acts on the contacting surface of the guide roller and woven fabric 1, and the weft of the woven fabric 1 is not shifted even when the cylindrical body 4 (widening roller) is reciprocated over the woven fabric, and the weaving yarn can be widened.

Though one cylindrical body over the full width of the woven fabric may be used as arrangement of the cylindrical body 4, it is difficult to put a pressure uniformly over the full width of the woven fabric by such a long cylindrical body. Therefore, though the illustration is omitted in the embodiment, the length of the cylindrical body is preferably 10 to 200 mm, and more preferably 10 to 50 mm. Two cylindrical bodies are attached to the both ends of a shaft in a state where the cylindrical bodies can be rotated by bearings. Since each shaft supports the central part and the load acts, uniform pressure can be put on the woven fabric by each roller. In the figures, two of the cylindrical bodies 4 of a two-piece unit are arranged in one sequence, and are arranged as one group in back to front two sequences. However, it is necessary to provide a support for supporting the shaft between two cylindrical bodies in the method, and there exits an interval which does not participate to the pressing of the roller between two cylindrical bodies. Therefore, as shown in FIG. 4, it is preferable that the cylindrical bodies 4 of a two-piece unit are alternately staggered in the direction of the movement of the woven fabric, and thereby the weaving yarn can be uniformly widened over the full width of woven fabric.

At this time, the movement speed in B direction of the woven fabric 1, that is, the weaving speed of the woven fabric is preferably low speed as much as possible since the speed of the reciprocation of the cylindrical body 4 is mechanically limited. However, the range of 0.2 to 2.0 m/min is preferable for the range which does not influence manufacture cost. When the yarn width widening apparatus shown in FIG. 3 is particularly provided while weaving between the cloth fell of the loom and the winding rolls of the woven fabric, it is preferably that the widening device can be provided in the same loom without being based on another step. Thus, when widening on the loom, another winding device is provided behind the loom as the winding device of the woven fabric, and the above guide roller 5 is provided. The width of the weaving yarn can be widened on the roller.

Figure 5:
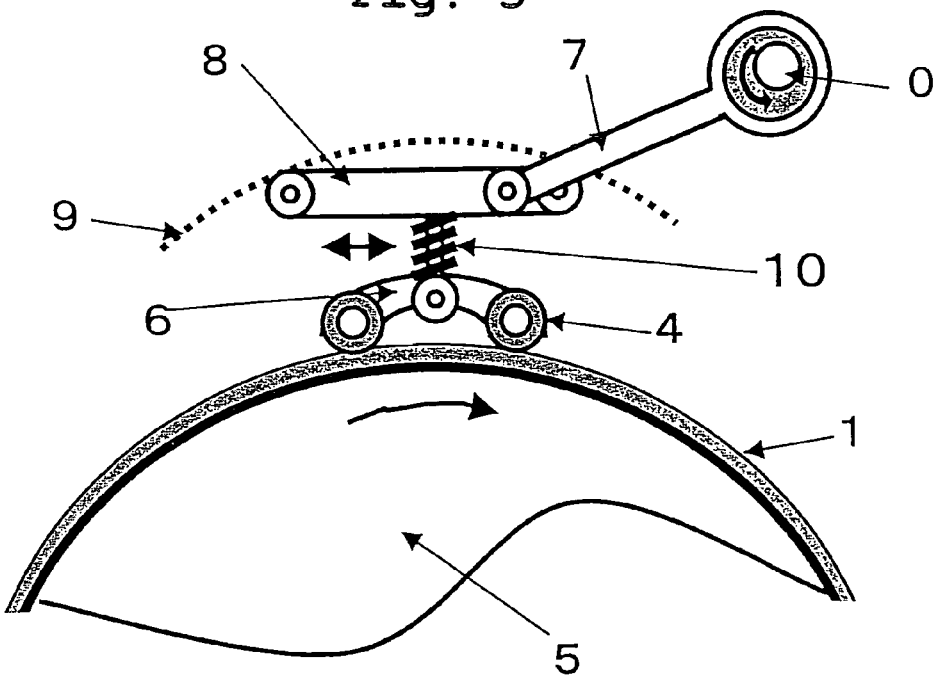
FIG. 5 is a partial sectional view for explaining an embodiment of an apparatus of the invention.

FIG. 5 is a partial side view of an apparatus for reciprocating a pair of the widening rollers 4 of back to front two unit in the direction of the warp while forcing with the suitable pressure to the surface of the woven fabric 1 on the guide roller 5. The central part of the shaft to which the cylindrical body 4 is attached is fixed to a horseshoe-shaped supporting arm 6, and the cylindrical bodies 4 of four units are attached to one supporting arm 6. Each supporting arm 6 is coupled with the pressing member 8, and the pressing member 8 performs a crank reciprocation around a rotation shaft O by a reciprocation drive coupling rod 7. The driving member 8 can perform a rocking movement in parallel in a concentric circle shape with the circle of the guide roller 5 by the guide 9 (not shown), and the compression spring 10 is interposed between the supporting arm 6 and the pressing member 8, and the pressure of the cylindrical body 4 is applied to one surface of the woven fabric in the pressing operation in the direction of the roller 5 of the compression spring 10. Though the diameter of the cylindrical body 4 is preferably is smaller as much as possible since high linear pressure can be applied by the same pressing load, the minimum diameter is determined from the bearing size since a bearing is incorporated in so as to make the rotation smooth. The diameter of the cylindrical body is 12 to 60 mm, and more preferably 12 to 20 mm.

The diameter of the cylindrical body 4 is preferably smaller as much as possible since high linear pressure is generated even in the same pressing load. However, when the diameter is set to less than 12 mm, a small bearing is formed and the cylindrical body 4 cannot sustain the high pressure. Thereby, it is necessary to set the diameter to 12 mm or more.

Though it is preferable that the length of the cylindrical body 4 is larger in view of the manufacture side, the length is preferably 200 mm or less so as to uniformly disperse the load in the longitudinal direction of the cylindrical body, and more preferably 50 mm or less. The surface of the cylindrical body is a preferably a smooth surface so as not to damage the carbon fiber, and the end part is preferably chamfered. Since particularly, the carbon fiber having high elastic modulus is brittle and easily damaged, the surface of the cylindrical body may be coated with a rubber.

Next, the reinforcing fiber woven fabric 1 used for the producing method of the invention will be described.

The woven fabric 1 uses reinforcing fiber yarns as the warp 2 and the weft 3, and the thick non-twist reinforcing fiber yarn having the fineness of 400 to 4,000 TEX is arranged in a large pitch. The fineness and weaving yarn pitch of the reinforcing fiber yarn have the following relationship. The opening ratio produced at the interlacing part of the warp and weft is 0.3 or less, and the size of an opening part is 1 $mm^2$ or lower.

$$P=k\cdot T^{1/2}$$

wherein

P: weaving yarn pitch (mm),

T: fineness of reinforcing fiber (TEX), k: $(18 \text{ to } 50)\times 10^{-2}$

When the reinforcing fiber is the carbon fiber, the fiber reinforced plastic having high specific tensile strength and specific modulus is preferably obtained.

As described in the prior art, weaving the low fiber a real weight carbon fiber woven fabric having the fiber a real weight of 80 to 300 $g/m^2$, which is conventionally woven by the thin carbon fiber yarn of fineness of 200 TEX or less, with the thick carbon fiber having the fineness of 400 to 4,000 TEX, the productivity of the woven fabric increases 2 to 20 times. Also, the manufacture cost of the thick carbon fiber yarn is inexpensive, the carbon fiber woven fabric of low cost can be provided.

Since the weaving yarn section of the thick carbon fiber has a flat shape and the weaving yarns interlace each other, the carbon fiber reinforced plastic having small crimp of the weaving yarn and exhibiting high mechanical property is expected.

However, it is difficult to make the woven fabric which has no gap between the weaving yarns and in which the carbon fiber is uniformly dispersed while keeping the flat shape of the thick carbon fiber flat yarn, and the woven fabric in which the opening part is formed in the interlacing part of the warp and weft is made. The opening part produced in the interlacing part of the warp and weft can be reduced by the yarn width widening method described above, and the woven fabric for reinforcement exhibiting the excellent mechanical property is obtained.

Here, the above opening ratio can be get by sampling from three different places of a woven fabric having the length of 1 m so as to include at least ten or more of the warp 2 and weft 3 and by measuring the interval and the width of ten of the warp and the weft at each sample by a slide caliper by 0.1 mm. The opening ratio can be calculated by the following formula (1) from each average value.

Opening Ratio (%)

$$= \frac{(\text{the warp interval} - \text{the warp width})\times(\text{the weft interval} - \text{the weft width})}{(\text{the warp interval}\times\text{the weft interval})}\times 100 \quad (1)$$

The opening area is the value of the numerator of the above formula. Though a yarn interval is the distance between the central lines of adjoining weaving yarn, the yarn interval should be the distance between the end part of the yarn width direction and the end part of the adjoining yarn when the opening ratio and opening area are calculated in the invention.

The opening ratio of the woven fabric of the invention is 0.3% or less, and the area of one opening part is 1 $mm^2$ or less.

When the woven fabric impregnated with the resin is molded to the carbon fiber plastic, a molded object in which a resin rich part does not exist is obtained since there is almost no opening part. The high mechanical property is exhibited, and the excellent surface grade can be obtained. When stresses act on a carbon fiber reinforced plastic having a resin rich part, the resin rich part becomes a starting point of destruction, and the carbon fiber reinforced plastic is destroyed by low load. Also, a hollow is generated in the resin rich part by the consolidation and shrinkage of the resin. In the drying step of the solvent in the case of producing prepreg by a flat weaving yarn and by a WET-prepreg method for dipping the woven fabric in which the large opening exists at the interlacing part of the warp and weft in the resin diluted by the solvent and impregnating the resin, the opening part can contain the resin only to the film thickness when the surface tension of the resin acts. Thereby, the flat carbon fiber yarn of the neighbors of the opening part is roundly converged, and the opening part is greatly opened to form prepreg. When the area of the opening part is 1 $mm^2$ or lower, the opening part can contain the resin sufficiently. Since the surface tension acts also to the resin existing in the opening part at the time of dryness of the solvent, the opening part is not enlarged.

EXAMPLE AND COMPARATIVE EXAMPLE

Hereinafter, Example and Comparative Example of the invention will be explained.

Example 1

In FIG. 1, the carbon fiber flat yarn having the number of filaments of 12,000, the tensile strength of 4800 MPa, the tensile elastic modulus of 230 GPa and the yarn width of 6 mm is used as the warp 2 and the weft 3. The flat yarn woven fabric 1 having the flat organization is woven by a rapier loom at the number of rotations of 80 RPM and the density where the weaving yarn pitches of the warp and the weft are respectively set to 8.3 mm.

Next, until the winding step, the weft 3 is opened and widened by an air jet injection of a supply air pressure of 0.5 Pa. The widening process is then performed by the widening method due to the cylindrical body 4 explained in FIG. 5. Referring to the widening process condition, the pressing load to the widening roller 4 is set to about 200 g per the length of 1 cm of one widening roller. The widening rollers are arranged at four sequences, and the amplitude (the direction of B of figure) is set to 50 mm. The frequency is set to two times/second.

Referring to the size of the cylindrical body 4, the diameter and the length are respectively set to 12 mm and 15 mm. The evaluation results of the woven fabrics before and after air jet process and woven fabric whose yarns are widened by the widening method due to the cylindrical body of the invention are shown in Table 1.

As a result, though the width of the weft is largely widened by the air jet process, the width of the warp is slightly narrow by the air jet process, and the width of the warp is largely widened in the direction of A by the yarn width widening method due to the widening roller process. The woven fabric in which the widths of both the warp and the weft are widened and which is very uniform having no gap in the interlacing part of the warp and weft is obtained.

Comparative Examples 1, 2

On the other hand, though the woven fabrics of Comparative examples 1, 2 are woven by the same method as Example 1, the woven fabric which does not use the opening widening process step due to the air jet injection and widening process step due to the cylindrical body 4 of the producing method of the invention is set to Comparative Example 1, and the woven fabric in which only the weft is opened by the air jet (woven fabric which does not use the widening process step due to the cylindrical body 4 of the producing method of the invention of) is set to Comparative Example 2. Those are shown in the following Table.

As a result, though the yarn width of the woven fabric of Comparative Example 1 is a little larger than the yarn width of the used carbon fiber flat yarn, the gap is generated in the interlacing part of the warp and the weft since the yarn widths are narrow to the weaving yarn interval, and the opening ratio is 3.3%. Large openings having the maximum opening area of 4.5 $mm^2$ exist.

Though the weft is widened by the air jet in the woven fabric of Comparative Example 2 and the width of the weft yarn is wide, the woven fabric has openings at the interlacing part of the warp and the weft since the width of the warp is narrow, where the openings are smaller than that of the woven fabric of Comparative Example 1. The woven fabric has the opening ratio of 0.4%. Although the opening ratio of the woven fabric of Comparative Example 2 is small, the width of the warp is narrow, thus the warp part is projected to the surface of the woven fabric and the woven fabric has the uneven surface.

The following Table 1 summarizes the Examples and Comparative Examples.

TABLE 1

| | Manufacture Condition | | The Warp Weaving Yarn | | The Weft Weaving Yarn | | | Area of Maximum |
|---|---|---|---|---|---|---|---|---|
| | Air Opening | Widening of the Invention | Interval Yarn Width (mm) | Weaving Yarn Interval (mm) | Interval Yarn Width (mm) | Weaving Yarn Interval (mm) | Opening ratio (%) | Opening Part ($mm^2$) |
| Example 1 | Presence | Presence | 8.3 | 7.9 | 8.3 | 8.3 | 0 | 0 |
| Comparative Example 1 | None | None | 8.3 | 7.1 | 8.3 | 6.4 | 3.3 | 4.5 |
| Comparative Example 2 | Presence | None | 8.3 | 6.9 | 8.3 | 8.1 | 0.4 | 1.5 |

INDUSTRIAL APPLICABILITY

According to the invention, the width of the weaving yarn can be effectively widened in the width direction of the woven fabric since the production method and the apparatus put a woven fabric consisting of the reinforcing fiber in the pressurization state by the cylindrical bodies rolling and reciprocating in the direction of the warp. Therefore, the fiber reinforced plastic product in which the reinforcing fiber is uniformly dispersed can be obtained as the base material for reinforcement of end products.

Particularly, the widening method used in the method for producing the reinforcing fiber woven fabric of the invention is a method in which a cylindrical body is reciprocated to the woven fabric while rolling in the direction of the warp to widen the width of the weaving yarn even when the reinforcing woven fabric is the woven fabric in which woven fabric slippage is easily generated as in the flat yarn woven fabric made of the carbon fiber. Thereby, the yarn width can be securely widened without disturbing the arrangement of the weaving yarn as in the prior art. Therefore, the woven fabric having no gap between the weaving yarns can be obtained.

Since the producing method and apparatus of the invention are very simple, the yarn width widening processing can be continuously performed on the loom.

Thereby, the producing method and apparatus for the invention can be widely used in fields such as the airplane member and the general industrial use.

The invention claimed is:

1. A method for producing a reinforcing fiber woven fabric in which a reinforcing fiber is a carbon fiber having a number of filaments of 6000 to 50000 and is woven as at least a warp, the method comprising reciprocating a plurality of cylindrical bodies in the direction of the warp of the woven fabric on the woven fabric which is not impregnated with resin such that the cylindrical bodies are rolled in a pressurization state to the woven fabric to widen the yarn width at least of the warp constituting the woven fabric in the direction of a weft, wherein a guide roller is rotatably brought into contact with a surface of the reinforcing woven fabric continuously passing through at a predetermined winding angle, the plurality of cylindrical bodies are rotatably supported on the woven fabric which is brought into contact with a surface of the guide roller.

2. The method for producing the reinforcing fiber woven fabric according to claim 1, wherein the pressure force of at least one cylindrical body to the woven fabric is 100 to 2000 g per 1 cm of the length of the axial direction of the cylindrical body.

3. The method for producing the reinforcing fiber woven fabric according to claim 2, wherein a widening rate for widening the yarn width of the warp in the direction of the weft is 2 to 50%.

4. The method for producing the reinforcing fiber woven fabric according to claim 1, wherein thick reinforcing fiber yarns of non-twist having a fineness of 400 to 4000 TEX are arranged in a weaving yarn pitch of 5 to 32 mm, and the fineness and weaving yarn pitch of the reinforcing fiber yarn have the following relationship, $$P=k\cdot T^{1/2}$$

wherein

P: weaving yarn pitch (mm),

T: fineness of reinforcing fiber (TEX), k: $(18 \text{ to } 50)\times 10^{-2}$.

5. The method for producing the reinforcing fiber woven fabric according to claim 1, wherein thick reinforcing fiber yarns of non-twist having a fineness of 400 to 4,000 TEX are arranged in a weaving yarn pitch of 4 to 16 mm;

the woven fabric is a uni-directional woven fabric integrated by the weft of a thin auxiliary yarn having a fineness of 1 to 30 TEX; and the fineness and weaving yarn pitch of the reinforcing fiber yarn have the following relationship, $$P=k\cdot T^{1/2}$$

wherein

P: weaving yarn (warp yarn) pitch (mm),

T: fineness of reinforcing fiber (TEX), k: $(10 \text{ to } 28)\times 10^{-2}$.

6. The method for producing the reinforcing fiber woven fabric according to claim 1, wherein a plurality of cylindrical bodies are alternately staggered in the direction of the warp yarn to widen the yarn width of the woven fabric.

7. The method for producing the reinforcing fiber woven fabric according to claim 1, wherein the woven fabric is moved in the direction of the warp along the surface of the guide roller capable of being rotated to continuously widen the yarn width of the woven fabric contacting with the surface of the guide roller.

8. The method for producing the reinforcing fiber woven fabric according to claim 1, wherein the yarn width is widened between a cloth fell of a loom and a winding roll of the woven fabric.

9. The method for producing the reinforcing fiber woven fabric according to claim 1, wherein an average speed for reciprocating the cylindrical bodies is 50 to 300 mm/second.

10. A method for producing a reinforcing fiber woven fabric, wherein the woven fabric is a flat yarn woven fabric having a warp and weft consisting of a carbon fiber yarn and having a flat woven fabric of plain weave, the method comprising the steps of:

opening and widening the weft by air jet injection from injection holes lined in the direction of the weft of the woven fabric; and widening the yarn width in the direction of the weft by the method of claim 1.

11. A method for producing a reinforcing fiber woven fabric, comprising:

weaving step of weaving a woven fabric while inserting a resin fiber having a melting point of 90 to 180° C. in the direction of a warp or a weft;

widening a yarn width by the method for producing according to claim 1; and heating the woven fabric to the softening point or melting point of the resin fiber or higher to stick the reinforcing fibers with each other or a reinforcing fiber and an auxiliary yarn by the resin.

12. The method for producing the reinforcing fiber woven fabric according to claim 1, further comprising the step of applying and adhering a powdery or fibrous resin on one side or both sides of the reinforcing fiber woven fabric, wherein the adhering amount of the resin is 2 to 20% by weight of the woven fabric.

13. An apparatus for producing a reinforcing fiber woven fabric in which a reinforcing fiber is a carbon fiber having a number of filaments of 6000 to 50000, comprising:

a guide roller which rotatably comes into contact with a surface of the reinforcing fiber woven fabric which is not impregnated with resin continuously passing through at a predetermined winding angle;

a plurality of cylindrical bodies rotatably supported on the woven fabric which comes into contact with the surface of the guide roller; and a driving part for reciprocating the cylindrical bodies in the direction of the warp of the woven fabric.

14. The apparatus for producing the reinforcing fiber woven fabric according to claim 13, wherein the cylindrical bodies have a diameter of 10 to 40 mm and a length of 10 to 50 mm, and the cylindrical bodies are alternately staggered in the direction of the warp of the woven fabric.

* * * * *